US009994797B2

(12) United States Patent
Hueffer et al.

(10) Patent No.: US 9,994,797 B2
(45) Date of Patent: Jun. 12, 2018

(54) FORMULATIONS, PREPARATION THEREOF, AND USE THEREOF AS, OR FOR PREPARING, DISHWASHING COMPOSITIONS

(71) Applicant: BASF SE, Ludwigshafen (DE)

(72) Inventors: Stephan Hueffer, Ludwigshafen (DE); Alejandra Garcia Marcos, Ludwigshafen (DE); Markus Hartmann, Neustadt (DE); Heike Weber, Mannheim (DE)

(73) Assignee: BASF SE, Ludwigshafen (DE)

( * ) Notice: Subject to any disclaimer, the term of this patent is extended or adjusted under 35 U.S.C. 154(b) by 0 days. days.

(21) Appl. No.: 14/771,100

(22) PCT Filed: Mar. 28, 2014

(86) PCT No.: PCT/EP2014/056312

§ 371 (c)(1),
(2) Date: Aug. 27, 2015

(87) PCT Pub. No.: WO2014/161786

PCT Pub. Date: Oct. 9, 2014

(65) Prior Publication Data

US 2016/0186098 A1 Jun. 30, 2016

(30) Foreign Application Priority Data

Apr. 2, 2013 (EP) ..... 13161998

(51) Int. Cl.

| | |
|---|---|
| ***C11D 3/00*** | (2006.01) |
| ***C11D 3/395*** | (2006.01) |
| ***C11D 3/04*** | (2006.01) |
| ***C11D 3/12*** | (2006.01) |
| ***C11D 3/20*** | (2006.01) |
| ***C11D 3/33*** | (2006.01) |
| ***C11D 3/37*** | (2006.01) |

(52) U.S. Cl.
CPC ..... *C11D 3/0073* (2013.01); *C11D 3/046* (2013.01); *C11D 3/1213* (2013.01); *C11D 3/2075* (2013.01); *C11D 3/2082* (2013.01); *C11D 3/33* (2013.01); *C11D 3/3723* (2013.01); *C11D 3/395* (2013.01)

(58) Field of Classification Search
CPC ..... C11D 3/0073; C11D 3/3723
USPC ..... 510/219
See application file for complete search history.

(56) References Cited

U.S. PATENT DOCUMENTS

| | | | | |
|---|---|---|---|---|
| 5,246,612 | A * | 9/1993 | Van Dijk | C11D 3/3932 252/186.38 |
| 5,599,781 | A * | 2/1997 | Haeggberg | C11D 3/3927 134/25.2 |
| 5,981,456 | A * | 11/1999 | Tartakovsky | C11D 3/0073 510/220 |
| 6,239,091 | B1 | 5/2001 | Tartakovsky et al. | |
| 6,281,180 | B1 | 8/2001 | Tartakovsky et al. | |
| 6,462,006 | B1 * | 10/2002 | Sorg | C11D 3/06 510/220 |
| 6,548,473 | B1 * | 4/2003 | Jacques Kamiel Thoen | C11D 17/0078 134/25.2 |
| 8,262,804 | B2 * | 9/2012 | Weber | C11D 1/72 134/25.2 |
| 8,535,450 | B2 * | 9/2013 | Hueffer | C11D 3/0073 134/25.2 |
| 8,574,374 | B2 | 11/2013 | Hueffer et al. | |
| 8,709,990 | B2 | 4/2014 | Hueffer et al. | |
| 8,846,593 | B2 | 9/2014 | Hueffer et al. | |
| 2007/0203047 | A1 * | 8/2007 | Pegelow | C11D 1/72 510/421 |
| 2013/0102515 | A1 * | 4/2013 | Hueffer | C11D 3/0073 510/219 |
| 2013/0284210 | A1 | 10/2013 | Huefer et al. | |
| 2013/0284211 | A1 | 10/2013 | Garcia Marcos et al. | |
| 2016/0186098 | A1 * | 6/2016 | Hueffer | C11D 3/0073 510/219 |

FOREIGN PATENT DOCUMENTS

| | | | | |
|---|---|---|---|---|
| DE | 198 19 187 | A1 | 11/1999 | |
| EP | 0 383 482 | A2 | 8/1990 | |
| EP | 0 561 452 | A1 | 9/1993 | |
| EP | 0 851 023 | A2 | 7/1998 | |
| EP | 1 721 962 | A1 | 11/2006 | |
| EP | 1721962 | A1 * | 11/2006 | C11D 3/0073 |
| EP | 2 118 254 | A1 | 11/2009 | |
| WO | WO 99/05248 | | 2/1999 | |

(Continued)

OTHER PUBLICATIONS

International Search Report dated Jul. 30, 2014, in PCT/EP2014/056312 filed Mar. 28, 2014.

*Primary Examiner* — Mark Eashoo
*Assistant Examiner* — M. Reza Asdjodi
(74) *Attorney, Agent, or Firm* — Oblon, McClelland, Maier & Neustadt, L.L.P.

(57) ABSTRACT

Formulations, comprising (A) in total in the range of 1 to 50% by weight of at least one compound, selected from methylglycinediacetic acid (MGDA), glutamic acid diacetate (GLDA) and salts thereof, (B) in total in the range of 0.01 to 0.4% by weight of at least one zinc salt, stated as zinc, (C) in total in the range of 0.001 to 0.045% by weight of homo- or copolymer of ethyleneimine, and (D) optionally 0.5 to 15% by weight of bleach, based in each case on the solids content of the respective formulation.

15 Claims, No Drawings

(56) References Cited

FOREIGN PATENT DOCUMENTS

| | | | | |
|---|---|---|---|---|
| WO | WO 2002/064719 | A1 | 8/2002 | |
| WO | WO 03/104370 | | 12/2003 | |
| WO | WO 2008/095562 | A1 | 8/2008 | |
| WO | WO 2010/020765 | A1 | 2/2010 | |
| WO | WO 2013/056996 | A1 | 4/2013 | |
| WO | WO 2013056996 | A1 * | 4/2013 | ..... C11D 3/0073 |

* cited by examiner

FORMULATIONS, PREPARATION THEREOF, AND USE THEREOF AS, OR FOR PREPARING, DISHWASHING COMPOSITIONS

The present invention relates to formulations comprising (A) in total in the range of 1 to 50% by weight of at least one compound, selected from methylglycinediacetic acid (MGDA), glutamic acid diacetate (GLDA) and salts thereof, (B) in total in the range of 0.01 to 0.4% by weight of at least one zinc salt, stated as zinc, (C) in total in the range of 0.001 to 0.045% by weight of homo- or copolymer of ethyleneimine, and (D) optionally 0.5 to 15% by weight of bleach, based in each case on the solids content of the respective formulation.

The present invention further relates to a process for preparing formulations according to the invention, and use thereof as, or for preparing, dishwashing compositions, in particular dishwashing compositions for machine dishwashing.

Dishwashing compositions have to fulfil many requirements. Thus, they have to thoroughly clean the crockery, they should not put any harmful or potentially harmful substances into the waste water, they should allow the draining and drying of water from the crockery, and they should not cause any problems in the operation of the dishwasher. Finally, they should not cause any undesired esthetic effects on the item to be cleaned. Glass corrosion is to be mentioned particularly in this context.

Glass corrosion occurs not only due to mechanical effects, for example, by glasses rubbing against one another or by mechanical contact of the glasses with parts of the dishwasher, but is primarily caused by chemical effects. For example, certain ions can be dissolved out of the glass by repeated machine washing which unfavourably alters the optical and thus the esthetic properties.

In glass corrosion, multiple effects are observed. Firstly, the formation of microscopic fine cracks can be observed which become noticeable in the form of lines. Secondly, in many cases, a general hazing can be observed, for example a roughening which renders the appearance of the affected glass unattractive. Such effects are also overall classified into iridescent discoloration, scratch formation and also contiguous and annular hazing.

EP 2 118 254 discloses that zinc salts can be used in combination with certain vinyl polymers as inhibitors for the prevention of glass corrosion.

In EP 0 383 482 it is proposed to use zinc salts having a particle diameter of less than 1.7 mm to reduce glass corrosion.

In WO 03/104370 it is proposed to use zinc-containing silicate coatings to avoid glass corrosion.

Numerous dishwashing compositions are known from U.S. Pat. No. 5,981,456 and WO 99/05248 where zinc salts or bismuth salts can be added to protect cutlery from tarnishing or corrosion.

WO 2002/64719 discloses that certain copolymers of ethylenically unsaturated carboxylic acids with, for example, esters of ethylenically unsaturated carboxylic acids, can be used in dishwashing compositions.

WO 2010/020765 discloses dishwashing compositions comprising polyethyleneimine. Such dishwashing compositions may comprise phosphate or be phosphate-free. A good inhibition of glass corrosion is attributed to these. Zinc- and bismuth-containing dishwashing compositions are not advised.

Glass corrosion, particularly line corrosion and hazing, is in many cases, however, still not adequately delayed or prevented.

The object was therefore to provide formulations which are suitable as, or for preparing, dishwashing compositions and which avoid the known disadvantages of the prior art and which inhibit, or at least particularly effectively reduce, glass corrosion. It was a further object to provide a process for preparing formulations which are suitable as, or for preparing, dishwashing compositions and which avoid the known disadvantages of the prior art. It was a further object to provide uses of the formulations.

Accordingly, the formulations defined above were found, also abbreviated to formulations according to the invention.

Formulations according to the invention comprise (A) in total in the range of 1 to 50% by weight of at least one compound, selected from methylglycinediacetic acid (MGDA), glutamic acid diacetate (GLDA) and salts thereof, in the context of the present invention also abbreviated to compound (A).

Compound (A) may be present as the free acid or preferably partially or completely in neutralised form, i.e. as the salt. Counter ions include for example inorganic cations, for example ammonium or alkali metals, particularly preferably $Na^+$, $K^+$, or organic cations, preferably ammonium substituted with one or more organic radicals, particularly triethanolammonium, N,N-diethanolammonium, N-mono-$C_1$-$C_4$-alkyldiethanolammonium, for example N-methyldiethanolammonium or N-n-butyldiethanolammonium, and N,N-di-$C_1$-$C_4$-alkylethanolammonium.

In one embodiment of the present invention, the compound (A) is selected from methylglycine diacetate (MGDA) and glutamic acid diacetate (GLDA) and preferably salts thereof, particularly sodium salts thereof. Very particularly preferred are glutamic acid diacetate (GLDA), the tetrasodium salt of GLDA, methylglycine diacetate and the trisodium salt of MGDA.

The starting amino acids alanine or glutamic acid may be selected from L-amino acids, R-amino acids and enantiomeric mixtures of amino acids, for example the racemates.

Formulations according to the invention comprise in total in the range of 0.01 to 0.4% by weight of at least one zinc salt (B). Zinc salts (B) can be selected from water-soluble and water-insoluble zinc salts. In the context of the present invention, zinc salts (B) referred to as insoluble in water are those having a solubility of 0.1 g/l or less in distilled water at 25° C. Accordingly, in the context of the present invention, zinc salts (B) having a higher water solubility are referred to as water-soluble zinc salts.

The proportion of zinc salt is stated as zinc or zinc ions. Thus the proportion of counterion may be calculated.

In one embodiment of the present invention, zinc salt (B) is selected from the group consisting of zinc benzoate, zinc gluconate, zinc lactate, zinc formate, $ZnCl_2$, $ZnSO_4$, zinc acetate, zinc citrate, $Zn(NO_3)_2$, $Zn(CH_3SO_3)_2$ and zinc gallate; preference is given to $ZnCl_2$, $ZnSO_4$, zinc acetate, zinc citrate, $Zn(NO_3)_2$, $Zn(CH_3SO_3)_2$ and zinc gallate.

In another embodiment of the present invention, zinc salt (B) is selected from ZnO, ZnO.aq, $Zn(OH)_2$ and $ZnCO_3$. Preference is given to ZnO.aq.

In one embodiment of the present invention, zinc salt (B) is selected from zinc oxides having an average particle diameter (weight average) in the range from 10 nm to 100 μm.

The cation in zinc salt (B) may be present as a complex, for example complexed with ammonia ligands or water ligands, and particularly hydrated. To simplify the notation in the context of the present invention, ligands are generally omitted if they are water ligands.

Depending on how the pH of the mixture according to the invention is adjusted, the zinc salt (B) may undergo conversion. Thus, it is possible, for example, to prepare the formulation according to the invention using zinc acetate or $ZnCl_2$, which undergoes conversion however, at a pH of 8 or 9 in an aqueous environment, to ZnO, $Zn(OH)_2$ or ZnO.aq, which may be present in complexed or non-complexed form.

Zinc salt (B) is present in those formulations according to the invention which are solid at room temperature preferably in the form of particles having, for example, an average diameter (number average) in the range of 10 nm to 100 μm, preferably 100 nm to 5 μm, determined for example by X-ray scattering.

Zinc salt (B) is present in those formulations according to the invention which are liquid at room temperature in dissolved or solid or colloidal form.

The formulation according to the invention further comprises in total 0.001 to 0.045% by weight of (C) at least one copolymer or preferably at least one homopolymer of ethyleneimine, together abbreviated also to polyethyleneimine (C).

In the context of the present invention, copolymers of ethyleneimine are understood also to mean copolymers of ethyleneimine (aziridine) having one or more higher homologs of ethyleneimine, such as propyleneimine (2-methylaziridine), 1- or 2-butyleneimine (2-ethylaziridine or 2,3-dimethylaziridine), for example having in total 0.01 to 75 mol % of one or more homologs of ethyleneimine, based on the proportion of ethyleneimine. However, preference is given to such copolymers which comprise only ethyleneimine and in the range of 0.01 to 5 mol % of homologs of ethyleneimine, in copolymerised form, and in particular homopolymers of ethyleneimine.

In one embodiment of the present invention copolymers of ethyleneimine (C) are selected from graft copolymers of ethyleneimine (C). In the context of the present invention, such graft copolymers are referred to also as ethyleneimine graft copolymers (C). Ethyleneimine graft copolymers (C) may be cross-linked or not cross-linked.

In one embodiment of the present invention, ethyleneimine graft copolymers (C) are selected from those polymers which are obtainable by grafting polyamidoamines with ethyleneimine. Ethyleneimine graft copolymers (C) are preferably composed of 10 to 90% by weight of polyamidoamine as graft base and 90 to 10% by weight of ethyleneimine as graft, in each case based on ethyleneimine graft copolymer (C).

Polyamidoamines are obtainable, for example, by condensation of polyalkylene polyamines in pure form, as a mixture with one another or in a mixture with diamines.

Polyalkylene polyamines are understood to mean, in the context of the present invention, those compounds comprising at least 3 basic nitrogen atoms in the molecule, for example diethylenetriamine, dipropylenetriamine, triethylenetetramine, tripropylenetetramine, tetraethylenepentamine, pentaethylenehexamine, N-(2-aminoethyl)-1,3-propanediamine and N,N'-bis(3-aminopropyl)ethylenediamine.

Suitable diamines are, for example, 1,2-diaminoethane, 1,3-diaminopropane, 1,4-diaminobutane, 1,6-diaminohexane, 1,8-diaminooctane, isophoronediamine, 4,4'-diaminodiphenylmethane, 1,4-bis-(3-aminopropyl)piperazine, 4,9-dioxadodecane-1,12-diamine, 4,7,10-trioxatridecane-1,13-diamine and α,ω-diamino compounds of polyalkylene oxides.

In another embodiment of the present invention, ethyleneimine graft copolymers (C) are selected from those polymers which can be produced by grafting polyvinylamines as graft base with ethyleneimine or oligomers of ethyleneimine, for example dimers or trimers of ethyleneimine. Ethyleneimine graft copolymers (C) are preferably based on 10 to 90% by weight of polyvinyl amine as graft base and 90 to 10% by weight of ethyleneimine as graft, in each case based on ethyleneimine graft copolymer (C).

Preferably, however, at least one polyethyleneimine (C) as a homopolymer is selected as a component of the formulation according to the invention, preferably not cross-linked.

According to a particular embodiment of the invention, polyethyleneimine (C) has a mean molecular weight $M_n$ of 500 g/mol to 125 000 g/mol, preferably 750 g/mol to 100 000 g/mol.

In one embodiment of the present invention, polyethyleneimine (C) has a mean molecular weight $M_w$ in the range of 500 to 1 000 000 g/mol, preferably in the range of 600 to 75 000 g/mol, particularly preferably in the range of 800 to 25 000 g/mol, determined for example by gel permeation chromatography (GPC).

In one embodiment of the present invention polyethyleneimine (C) is selected from highly branched polyethyleneimines. Highly branched polyethyleneimines (C) are characterised by their high degree of branching (DB). The degree of branching can be determined, for example, by $^{13}C$-NMR spectroscopy, preferably in $D_2O$, and is defined as follows:

$$DB=D+T/D+T+L$$

where D (dendritic) corresponds to the proportion of tertiary amino groups, L (linear) corresponds to the proportion of secondary amino groups and T (terminal) corresponds to the proportion of primary amino groups.

In the context of the present invention, polyethyleneimines (C) having a DB in the range of 0.1 to 0.95, preferably 0.25 to 0.90, particularly preferably in the range of 0.30 to 0.80% and especially preferably at least 0.5 are classified as highly branched polyethyleneimines (C).

In the context of the present invention, polyethyleneimines (C) having a structural and molecular unit composition are classified as dendrimeric polyethyleneimines (C).

In an embodiment of the present invention, polyethyleneimine (C) is a highly branched polyethyleneimine (homopolymer) having a mean molecular weight $M_w$ in the range of 600 to 75 000 g/mol, preferably in the range of 800 to 25 000 g/mol.

According to a particular embodiment of the present invention polyethyleneimine (C) is a highly branched polyethyleneimine (homopolymer) having a mean molecular weight $M_n$ of 500 g/mol to 125 000 g/mol, preferably 750 g/mol to 100 000 g/mol, which is selected from dendrimers.

In another particular embodiment of the present invention, polyethyleneimine (C) is a linear or substantially linear polyethyleneimine (homopolymer) having a mean molecular weight $M_w$ in the range of 600 to 75 000 g/mol, preferably in the range of 800 to 25 000 g/mol.

In one embodiment of the present invention, formulations according to the invention comprise in total in the range of 1 to 50% by weight of compound (A), preferably 10 to 40% by weight, in total in the range of 0.01 to 0.4% by weight of zinc salt (B), preferably 0.05 to 0.2% by weight, calculated as Zn, and in total 0.001 to 0.045% by weight of homo- or copolymer of ethyleneimine (C), preferably 0.01 to 0.04% by weight, optionally in total 0.5 to 15% by weight of bleach (D), in each case based on the solids content of the respective formulation.

In one embodiment of the present invention, the inventive formulation is solid at room temperature, for example a powder or tablet. In another embodiment of the present invention, the inventive formulation is liquid at room temperature. In one embodiment of the present invention, the inventive formulation is a granular material, a liquid preparation or a gel.

In one embodiment of the present invention, the formulation according to the invention comprises 0.1 to 10% by weight of water, based on the sum of all solids of the respective formulation.

Without wishing to give preference to a particular theory, it is possible, in the formulations according to the invention, that zinc salt (B) may be present in a form complexed with polyethyleneimine (C).

In one embodiment of the present invention, the formulation according to the invention is free from phosphates and polyphosphates, including hydrogen phosphates, for example free from trisodium phosphate, pentasodium tripolyphosphate and hexasodium metaphosphate. In connection with phosphates and polyphosphates in the context of the present invention, "free from" shall be understood to mean that the content of phosphate and polyphosphate in total is in the range of 10 ppm to 0.2% by weight, determined gravimetrically.

In one embodiment of the present invention, the formulation according to the invention is free from those heavy metal compounds which do not act as bleach catalysts, in particular iron and bismuth compounds. In connection with heavy metal compounds in the context of the present invention, "free from" shall be understood to mean that the content of heavy metal compounds, which do not act as bleach catalysts, in total is in the range of 0 to 100 ppm, preferably 1 to 30 ppm, determined according to the leaching methods.

In the context of the present invention, all metals having a specific density of at least 6 g/cm$^3$, except zinc, are classified as "heavy metals". In particular noble metals and also bismuth, iron, copper, lead, tin, nickel, cadmium and chromium are classified as heavy metals.

The formulation according to the invention preferably comprises no measurable amounts of bismuth compounds, thus for example less than 1 ppm.

In one embodiment of the present invention, the formulation according to the invention comprises one or more bleaches (D), for example one or more oxygen bleaches or one or more chlorine-containing bleaches.

The formulations according to the invention may contain, for example, 0.5 to 15% by weight of bleach (D).

Examples of suitable oxygen bleaches are sodium perborate, anhydrous or, for example, as the monohydrate or tetrahydrate or the so-called dihydrate, sodium percarbonate, anhydrous or, for example, as the monohydrate, hydrogen peroxide, persulfates, organic peracids such as peroxylauric acid, peroxystearic acid, peroxy-α-naphthoic acid, 1,12-diperoxydodecanedioic acid, perbenzoic acid, peroxylauric acid, 1,9-diperoxyazelaic acid, diperoxyisophthalic acid, in each case as free acid or as alkali metal salt, particularly as sodium salt, furthermore sulfonylperoxy acids and cationic peroxy acids.

The formulations according to the invention may comprise, for example, in the range of 0.5 to 15% by weight of oxygen bleach.

Suitable chlorine-containing bleaches are for example 1,3-dichloro-5,5-dimethylhydantoin, N—N-chlorosulfamide, chloramine T, chloramine B, sodium hypochlorite, calcium hypochlorite, magnesium hypochlorite, potassium hypochlorite, potassium dichloroisocyanurate and sodium dichloroisocyanurate.

Formulations according to the invention may comprise, for example, in the range of 3 to 10% by weight of chlorine-containing bleach.

In one embodiment of the present invention, the formulation according to the invention may have further ingredients (E), for example one or more surfactants, one or more enzymes, one or more builders, in particular phosphorus-free builders, one or more cobuilders, one or more alkali metal carriers, one or more bleach catalysts, one or more bleach activators, one or more bleach stabilizers, one or more anti-foams, one or more corrosion inhibitors, buffers, dyes, one or more fragrances, one or more organic solvents, one or more tableting auxiliaries, one or more disintegrants, one or more thickeners, or one or more solubility promoters.

Examples of surfactants are in particular non-ionic surfactants and also mixtures of anionic or zwitterionic surfactants with non-ionic surfactants. Preferred non-ionic surfactants are alkoxylated alcohols and alkoxylated fatty alcohols, di- and multiblock copolymers of ethylene oxide and propylene oxide and reaction products of sorbitan with ethylene oxide or propylene oxide, alkyl glycosides and so-called amine oxides.

Preferred examples of alkoxylated alcohols and alkoxylated fatty alcohols are, for example, compounds of the general formula (I)

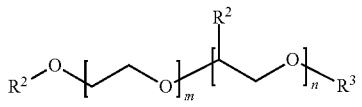

(I)

in which the variables are defined as follows:

$R^1$ is identical or different and selected from linear $C_1$-$C_{10}$-alkyl, preferably ethyl and particularly preferably methyl, $R^2$ is selected from $C_8$-$C_{22}$-alkyl, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^3$ is selected from $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, m and n are in the range from 0 to 300, where the sum of n and m is at least one. Preferably, m is in the range from 1 to 100 and n is in the range from 0 to 30.

Here, compounds of the general formula (I) may be block copolymers or random copolymers, preferably block copolymers.

Other preferred examples of alkoxylated alcohols and alkoxylated fatty alcohols are, for example, compounds of the general formula (II)

(II)

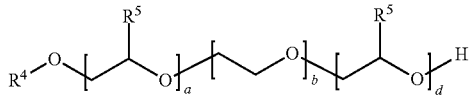

in which the variables are defined as follows:

$R^5$ is identical or different and selected from linear $C_1$-$C_4$-alkyl, preferably identical in each case and ethyl and particularly preferably methyl, $R^4$ is selected from $C_6$-$C_{20}$-alkyl, in particular n-$C_8H_{17}$, n-$C_{10}H_{21}$, n-$C_{12}H_{25}$, n-$C_{14}H_{29}$, n-$C_{16}H_{33}$, n-$C_{18}H_{37}$.

a is a number in the range from 1 to 6, b is a number in the range from 4 to 20, d is a number in the range from 4 to 25.

Here, compounds of the general formula (II) can be block copolymers or random copolymers, preferably block copolymers.

Further examples of non-ionic surfactants are compounds of the general formula (III)

(III)

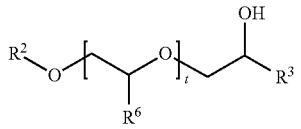

In this case the variables are defined as follows:

$R^6$ is identical or different and selected from hydrogen, methyl and ethyl, preferably identical or different and selected from methyl and hydrogen, t is in the range of 1 to 50, $R^2$ and $R^3$ are as defined previously.

Further suitable non-ionic surfactants are selected from di- and multiblock copolymers, composed of ethylene oxide and propylene oxide. Further suitable non-ionic surfactants are selected from ethoxylated or propoxylated sorbitan esters. Amine oxides or alkyl polyglycosides are likewise suitable. An overview of further suitable non-ionic surfactants can be found in EP-A 0 851 023 and in DE-A 198 19 187.

Mixtures of two or more different non-ionic surfactants may also be present.

Examples of anionic surfactants are $C_8$-$C_{20}$-alkylsulfates, $C_8$-$C_{20}$-alkylsulfonates and $C_8$-$C_{20}$-alkyl ether sulfates having 1 to 6 ethylene oxide units per molecule.

In one embodiment of the present invention, formulation according to the invention may comprise surfactant in the range of 3 to 20% by weight, based on the solids content of the respective formulation.

Formulations according to the invention may comprise one or more enzymes. Examples of enzymes are lipases, hydrolases, amylases, proteases, cellulases, esterases, pectinases, lactases and peroxidases.

Formulations according to the invention may, for example, comprise up to 5% by weight of enzyme, preferably 0.1 to 3% by weight, in each case based on the total solids content of the formulation according to the invention.

Formulations according to the invention may comprise one or more builders, in particular phosphate-free builders. Examples of suitable builders are silicates, particularly sodium disilicate and sodium metasilicate, zeolites, sheet silicates, particularly those of the formula α-$Na_2Si_2O_5$, β-$Na_2Si_2O_5$, and δ-$Na_2Si_2O_5$, also citric acid and alkali metal salts thereof, succinic acid and alkali metal salts thereof, fatty acid sulfonates, α-hydroxypropionic acid, alkali metal malonates, fatty acid sulfonates, alkyl- and alkenyl disuccinates, tartaric acid diacetate, tartaric acid monoacetate, oxidized starch, and polymeric builders, for example polycarboxylates and polyaspartic acid.

In one embodiment of the present invention, builders are selected from polycarboxylates, for example alkali metal salts of (meth)acrylic acid homopolymers or (meth)acrylic acid copolymers.

Suitable comonomers of (meth)acrylic acid homopolymers or (meth)acrylic acid copolymers are monoethylenically unsaturated dicarboxylic acids such as maleic acid, fumaric acid, maleic anhydride, itaconic acid and citraconic acid. A particularly suitable polymer is polyacrylic acid preferably having an average molecular weight $M_w$ in the range of 2000 to 40 000 g/mol, preferably 2000 to 10 000 g/mol, particularly 3000 to 8000 g/mol. Also suitable are copolymeric polycarboxylates, particularly those of acrylic acid with methacrylic acid and of acrylic acid or methacrylic acid with maleic acid and/or fumaric acid.

It is also possible to use copolymers of at least one monomer from the group consisting of monoethylenically unsaturated $C_3$-$C_{10}$-mono- or dicarboxylic acids or anhydrides thereof, such as maleic acid, maleic anhydride, acrylic acid, methacrylic acid, fumaric acid, itaconic acid and citraconic acid having at the least one hydrophilically or hydrophobically modified monomer as listed below.

Suitable hydrophobic monomers are, for example, isobutene, diisobutene, butene, pentene, hexene and styrene, olefins having 10 or more carbon atoms or mixtures thereof, such as 1-decene, 1-dodecene, 1-tetradecene, 1-hexadecene, 1-octadecene, 1-eicosene, 1-docosene, 1-tetracosene and 1-hexacosene, $C_{22}$-α-olefin, a mixture of $C_{20}$-$C_{24}$-α-olefins and polyisobutene having, on average, 12 to 100 carbon atoms.

Suitable hydrophilic monomers are monomers having sulfonate or phosphonate groups, and also non-ionic monomers having hydroxyl function or alkylene oxide groups. Examples include: allyl alcohol, isoprenol, methoxypolyethylene glycol(meth)acrylate, methoxypolypropylene glycol (meth)acrylate, methoxypolybutylene glycol(meth)acrylate, methoxypoly(propylene oxide-co-ethylene oxide)(meth) acrylate, ethoxypolyethylene glycol(meth)acrylate, ethoxypolypropylene glycol(meth)acrylate, ethoxypolybutylene glycol(meth)acrylate and ethoxypoly(propylene oxide-co-ethylene oxide)(meth)acrylate. The polyalkylene glycols here comprise 3 to 50, in particular 5 to 40 and especially 10 to 30 alkylene oxide units.

Particularly preferred monomers containing sulfonic acid groups here are 1-acrylamido-1-propanesulfonic acid, 2-acrylamido-2-propanesulfonic acid, 2-acrylamido-2-methylpropanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide and salts of said acids, such as their sodium, potassium or ammonium salts.

Particularly preferred monomers containing phosphonate groups are vinylphosphonic acid and salts thereof.

Moreover, amphoteric polymers may also be used as builders.

Formulations according to the invention may comprise, for example, in the range from in total 10 to 50% by weight, preferably up to 20% by weight, of builders, based on the solids content of the respective formulation.

In one embodiment of the present invention, the formulations according to the invention may comprise one or more cobuilders.

Examples of cobuilders are phosphonates, for example hydroxyalkanephosphonates and aminoalkanephosphonates. Among the hydroxyalkanephosphonates, 1-hydroxyethane-1,1-diphosphonate (HEDP) is of particular importance as cobuilder. It is preferably used as the sodium salt, the disodium salt being neutral and the tetrasodium salt being alkaline (pH 9). Suitable aminoalkanephosphonates are preferably ethylenediaminetetramethylenephosphonate (EDTMP), diethylenetriaminepentamethylenephosphonate (DTPMP) and also higher homologs thereof. They are preferably used in the form of the neutrally reacting sodium salts, e.g. as the hexasodium salt of EDTMP or as the hepta- and octasodium salts of DTPMP.

Formulations according to the invention may comprise one or more alkali carriers. Alkali carriers provide, for example, a pH of at least 9, if an alkaline pH is desired. For example, alkali metal carbonates, alkali metal hydrogen carbonates, alkali metal hydroxides and alkali metal metasilicates are suitable. A preferred alkali metal is in each case potassium, particular preference being given to sodium.

Formulations according to the invention may comprise one or more bleach catalysts. Bleach catalysts can be selected from bleach-enhancing transition metal salts or transition metal complexes such as manganese-, iron-, cobalt-, ruthenium- or molybdenum-salen complexes or manganese-, iron-, cobalt-, ruthenium- or molybdenum-carbonyl complexes. It is also possible to use manganese, iron, cobalt, ruthenium, molybdenum, titanium, vanadium and copper complexes with nitrogen-containing tripod ligands and also cobalt-, iron-, copper- and ruthenium-amine complexes as bleach catalysts.

Formulations according to the invention may comprise one or more bleach activators, for example N-methylmorpholinium-acetonitrile salts ("MMA salts"), trimethylammoniumacetonitrile salts, N-acylimides such as N-nonanoylsuccinimide, 1,5-diacetyl-2,2-dioxohexahydro-1,3,5-triazine ("DADHT") or nitrile quats (trimethylammoniumacetonitrile salts).

Further examples of suitable bleach activators are tetraacetylethylenediamine (TAED) and tetraacetylhexylenediamine.

Formulations according to the invention may comprise one or more corrosion inhibitors. In the present context, this is understood to mean those compounds which inhibit metal corrosion. Examples of suitable corrosion inhibitors are triazoles, particularly benzotriazoles, bisbenzotriazoles, aminotriazoles, alkylaminotriazoles, also phenol derivatives such as hydroquinone, pyrocatechin, hydroxyhydroquinone, gallic acid, phloroglucino or pyrogallol.

In one embodiment of the present invention, formulations according to the invention comprise in total in the range from 0.1 to 1.5% by weight of corrosion inhibitor, based on the solids content of the respective formulation.

Formulations according to the invention may comprise one or more builders, for example sodium sulfate.

Formulations according to the invention may comprise one or more anti-foams, selected for example from silicone oils and paraffin oils.

In one embodiment of the present invention, formulations according to the invention comprise in total in the range from 0.05 to 0.5% by weight of anti-foam, based on the solids content of the respective formulation.

In one embodiment of the present invention, formulations according to the invention may comprise salts of one or more additional acids, for example the sodium salt of methanesulfonic acid.

In one embodiment of the present invention, formulations according to the invention have a pH in the range from 5 to 14, or preferably 8 to 13.

The present invention further relates to the use of formulations according to the invention for the machine cleaning of crockery and kitchen utensils. Within the context of the present invention, kitchen utensils to be mentioned are, for example, pots, pans, casseroles, also metallic items such as skimmers, fish slices and garlic presses.

Preference is given to the use of formulations according to the invention for machine cleaning of items having at least one glass surface which may be decorated or undecorated. In this connection, within the context of the present invention, a surface made of glass is to be understood as meaning that the item in question has at least one section made of glass which comes into contact with the surrounding air and may be soiled upon using the item. Thus, the items in question may be those which, like drinking glasses or glass bowls, are essentially made of glass. However, they may, for example, also be lids which have individual components made of another material, for example pot lids with edges and handle made of metal.

Surface made of glass may be decorated, for example colored or imprinted, or undecorated.

The term "glass" includes any desired glasses, for example lead glass and in particular soda-lime glass, crystal glass and borosilicate glasses.

Preferably, machine cleaning is a washing operation using a dishwasher (automatic dishwashing).

In one embodiment of the present invention, at least one formulation according to the invention is used for machine cleaning of drinking glasses, glass vases and glass vessels for cooking.

In one embodiment of the present invention, water with a hardness in the range from 1 to 30° German hardness, preferably 2 to 25° German hardness, is used for the cleaning, where German hardness is to be understood in particular as meaning the calcium hardness.

If formulations according to the invention are used for machine cleaning, then, even upon the repeated machine cleaning of objects which have at least one surface made of glass, only a very low tendency towards glass corrosion is observed, and then only if objects which have at least one surface made of glass are cleaned together with heavily soiled cutlery or crockery. Moreover, it is significantly less harmful to use formulation according to the invention for cleaning glass together with objects made of metal, for example together with pots, pans or garlic presses.

The present invention further provides a process for preparing formulations according to the invention, also abbreviated to preparation process according to the invention. To carry out the preparation process according to the invention, the procedure may involve, for example, mixing with one another, for example stirring, (A) at least one compound selected from MGDA, GLDA and salts thereof, (B) at least one zinc salt, (C) at least one homo- or copolymer of ethyleneimine and optionally bleach (D) and/or further ingredients (E) in one or more steps, in the presence of water, and subsequently removing the water, completely or at least partially. Compound (A), zinc salt (B), polyethyleneimine (C) and optionally bleach (D) and/or further ingredients (E) are preferably used here in the proportions previously described.

Compound (A), zinc salt (B) and polyethyleneimine (C) and also bleach (D) and further ingredient(s) (E) are defined above.

In one embodiment of the present invention, before the water is at least partially removed, it is possible to mix in one or more further ingredients (E) for formulation according to the invention, for example one or more surfactants, one or more enzymes, one or more builders, in particular phosphorus-free builders, one or more cobuilders, one or more alkali carriers, one or more bleach catalysts, one or more bleach activators, one or more bleach stabilizers, one or more anti-foams, one or more corrosion inhibitors, buffer or dye.

In one embodiment, the procedure involves removing the water completely or partially, for example to a residual moisture in the range from zero to 5% by weight, from formulation according to the invention by evaporation, in particular by spray-drying, spray granulation or compaction.

In a further embodiment of the present invention, (A) at least one compound selected from MGDA, GLDA and salts thereof, and (C) at least one homo- or copolymer of ethyleneimine are firstly mixed in the presence of water, the water then removed completely or at least partially, and then mixed with zinc salt (B), with or without water, and optionally with one or more bleaches (D) or with one or more further ingredients (E).

In one embodiment of the present invention, the water is removed, completely or partially, at a pressure in the range from 0.3 to 2 bar.

In one embodiment of the present invention, the water is removed, completely or partially, at temperatures in the range of 60 to 220° C.

By means of the preparation process according to the invention, formulations according to the invention can be readily obtained.

The cleaning of formulations according to the invention can be provided in liquid or solid form, in single-phase or multi-phase, as tablets or in the form of other metering units, in packaged or unpackaged form. The water content of the liquid formulations can vary from 35 to 90% water.

The invention is illustrated by working examples.

General: it was ensured that following the first cleaning of the test pieces in the domestic dishwasher until after weighing and visual assessment of the glasses, the test pieces were only handled using clean cotton gloves so that the weight and/or the visual impression of the test pieces was not falsified.

Within the scope of the present invention, % and ppm are always % by weight and ppm by weight, unless expressly stated otherwise, and, in the case of formulations according to the invention, are based on the total solids content.

I. Production of Formulations According to the Invention

I.1 Production of Base Mixtures

Initially, base mixtures were prepared which comprised the feed substances according to Table 1. The feed substances were mixed dry.

TABLE 1

Base mixtures for experiments with formulations according to the invention and comparative formulations

| | Base 1 | Base 2 | Base 3 |
|---|---|---|---|
| Protease | 2.5 | 2.5 | 2.5 |
| Amylase | 1 | 1 | 1 |
| n-$C_{18}H_{37}(OCH_2CH_2)_9OH$ | 5 | 5 | 5 |

TABLE 1-continued

Base mixtures for experiments with formulations according to the invention and comparative formulations

| | Base 1 | Base 2 | Base 3 |
|---|---|---|---|
| Polyacrylic acid $M_w$ 4000 g/mol as sodium salt, fully neutralized | 10 | 10 | 10 |
| Sodium percarbonate (D.1) | 10.5 | 10.5 | 10.5 |
| TAED | 4 | 4 | 4 |
| $Na_2Si_2O_5$ | 2 | 2 | 2 |
| $Na_2CO_3$ | 19.5 | 19.5 | 19.5 |
| Sodium citrate dihydrate | 0 | 22.5 | 30 |
| HEDP | 0.5 | 0.5 | 0.5 |

Note:
all quantitative data in g.

Abbreviations:

MGDA: methylglycinediacetic acid as trisodium salt

TAED: N,N,N',N'-tetraacetylethylenediamine

HEDP: disodium salt of hydroxyethane(1,1-diphosphonic acid)

I.2 Production of Formulations According to the Invention

In a 100 ml beaker, 20 ml of distilled water were introduced and the following were added in succession with stirring:

Zinc salt (B.1) or (B.2) according to Table 2 (or 3)

Polyethyleneimine (C.1), (C.2) or (C.3) according to Table 2 (or 3)

The mixture was stirred for 10 minutes at room temperature. MGDA trisodium salt (A1), dissolved in 30 ml of water, was then added according to Table 2 (or 3). This gave a clearly transparent solution. The water was evaporated. Then, base mixture according to Table 2 (or 3) was added and the dry ingredients were mixed.

This gave formulations according to the invention which were tested according to Table 2 (or 3).

To prepare comparative formulations, the procedure was analogous except the zinc salt (B) or the polyethyleneimine (C), or both, was/were omitted.

If, in the "Dishwasher with continuous operation" test (or in the immersion test), the corresponding fractions of base mixture were added separately from aqueous solution of (A.1), (B) or (C), the same results were obtained as when the dried formulation with identical amounts of active ingredient was tested. It is thus not a question of the order of the addition.

(B.1): $ZnSO_4.7H_2O$. Quantities are based on zinc.

(B.2): ZnO. Quantities are based on zinc.

(C.1): Polyethyleneimine homopolymer, $M_w$ 800 g/mol, DB=0.63

(C.2): Polyethyleneimine homopolymer, $M_w$ 5000 g/mol, DB=0.67

(C.3): Polyethyleneimine homopolymer, $M_w$ 25 000 g/mol, DB=0.70

II. Use of Formulations According to the Invention and Comparative Formulations for the Machine Cleaning of Glasses The testing of formulations according to the invention and comparative formulations was carried out as follows.

II.1 Dishwasher with Continuous Operation Test Method

Dishwasher: Miele G 1222 SCL

Program: 65° C. (with prewash)

Ware: 3 "GILDE" champagne glasses, 3 "INTERMEZZO" brandy glasses

For the cleaning, the glasses were arranged in the upper crockery basket of the dishwasher. The dishwashing composition used was in each case 18 g of formulation according to the invention or comparative formulation according to Table 2, where Table 2 specifies the active components (A.1), optionally (B), optionally (C) and base mixture of formulation according to the invention in each case individually. Washing was carried out at a clear-rinse temperature of 65° C. The water hardness was in each case in the range from 0 to 2° German hardness. Washing was carried out in each case for 50 wash cycles, i.e. the program was left to run 50×. The evaluation was carried out gravimetrically and visually after 50 wash cycles.

The weight of the glasses was determined before the start of the first wash cycle and after drying after the last wash cycle. The weight loss is the difference in the two values.

As well as the gravimetric evaluation, a visual assessment of the ware after 100 cycles in a darkened chamber with light behind a perforated plate was given using a grading scale from 1 (very poor) to 5 (very good). In this connection, the grades were determined in each case for patchy corrosion/haze and/or line corrosion.

II.2 Immersion Test Method

Equipment:

Stainless steel pot (volume ca. 6 liters) with lid with hole for contact thermometer Mesh base insert with mounting for the stainless steel pot Magnetic stirrer with stirrer rod, contact thermometer, rubber stopper with hole Experimental Conditions:

Temperature: 75° C.

Time: 72 hours 5 liters of distilled water or water with defined water hardness ("hardness water")

The test pieces used were in each case a champagne glass and a brandy glass from Libbey (NL), material: soda-lime glasses.

Experimental Procedure:

For the purposes of the pretreatment, the test pieces were firstly washed in a domestic dishwasher (Bosch SGS5602) with 1 g of a surfactant (n-$C_{18}H_{37}(OCH_2CH_2)_{10}OH$) and 20 g of citric acid in order to remove any contaminations. The test pieces were dried, their weight was determined, and they were fixed to the mesh base insert.

The stainless steel pot was filled with 5.5 liters of water and 18 g of the formulation according to the invention or comparative formulation were added, where Table 3 specifies the active components (A.1), optionally (B), optionally (C) and base mixture of formulation according to the invention or comparative formulation individually in each case. The cleaning liquor obtained in this way was stirred using the magnetic stirrer at 550 revolutions per minute. The contact thermometer was installed and the stainless steel pot was covered with the lid so that no water could evaporate during the experiment. It was heated to 75° C. and the mesh base insert with the two test pieces was placed into the stainless steel pot, it being ensured that the test pieces were completely immersed into the liquid.

At the end of the experiment, the test pieces were taken out and rinsed under running distilled water. The test pieces were then washed in the domestic dishwasher using a formulation consisting of 1 g of surfactant (n-$C_{18}H_{37}(OCH_2CH_2)_{10}OH$) and 20 g of citric acid, again using the 55° C. program, in order to remove any deposits.

In order to assess the gravimetric abrasion, the dry test pieces were weighed. The visual assessment of the test pieces was then carried out. For this, the surface of the test pieces was assessed with regard to line corrosion (glass ridges) and hazing corrosion (sheet-like hazing).

The evaluations were carried out in accordance with the following scheme.

Line Corrosion:

L5: no lines visible

L4: slight line formation in very few areas, fine line corrosion

L3: line corrosion in a few areas

L2: line corrosion in several areas

L1: severe line corrosion

Glass Hazing

L5: no hazing visible

L4: slight hazing in very few areas

L3: hazing in a few areas

L2: hazing in several areas

L1: severe hazing over virtually the whole glass surface

During the assessment, intermediate grades (e.g. L3-4) were also allowed.

If, instead of water, hardness water with 2° German hardness was used for the tests, then formulations according to the invention were likewise always superior to the corresponding comparative formulations in terms of the inhibition of the glass corrosion.

II.3 Results

The results are summarised in Tables 2 and 3.

TABLE 2

Results of the tests with dishwasher (continuous operation)

| Example | Base mixture: [g] | (A.1) [g] | (B) [mg] | (C) [mg] | Weight loss champagne glass [mg] | Weight loss brandy glass [mg] | Visual evaluation champagne glass | Visual evaluation brandy glass |
|---|---|---|---|---|---|---|---|---|
| V-D3.1 | Base 3: 16.2 | 1.8 | — | — | 75 | 45 | L1, T2 | L1, T1-2 |
| V-D3.2 | Base 3: 16.2 | 1.8 | 36 | — | 50 | 30 | L1, T3 | L1, T3 |
| V-D1.1 | Base 1: 9.9 | 8.1 | — | — | 82 | 53 | L1, T1-2 | L1, T1-2 |
| V-D1.2 | Base 1: 9.9 | 8.1 | 36 | — | 65 | 41 | L1, T2-3 | L1, T2-3 |
| V-D1.3 | Base 1: 9.9 | 8.1 | — | 7.5 | 36 | 19 | L2-3, T3-4 | L2-3, T4 |
| D1.4 | Base 1: 9.9 | 8.1 | 3.6 | 7.5 | 21 | 11 | L3, T4 | L3-4, T4-5 |
| D1.5 | Base 1: 9.9 | 8.1 | 9 | 7.5 | 17 | 8 | L3-4, T4-5 | L4, T4-5 |
| D1.6 | Base 1: 9.9 | 8.1 | 18 | 7.5 | 16 | 7 | L4, T4-5 | L4-5, T5 |
| V-D3.3 | Base 3: 16.2 | 1.8 | — | 1.7 | 34 | 16 | L2-3, T3-4 | L2-3, T3-4 |
| D3.4 | Base 3: 16.2 | 1.8 | 18 | 1.7 | 16 | 8 | L4, T4-5 | L4, T4-5 |
| D3.5 | Base 3: 16.2 | 1.8 | 36 | 1.7 | 12 | 7 | L4, T4-5 | L4-5, T5 |

TABLE 3

| Immersion tests | | | | | | | | |
|---|---|---|---|---|---|---|---|---|
| Example | Base mixture: [g] | (A.1) [g] | (B) [mg] | (C) [mg] | Weight loss champagne glass [mg] | Weight loss brandy glass [mg] | Visual evaluation champagne glass | Visual evaluation brandy glass |
| V-I.3.1 | Base 3: 15.3 | 2.7 | — | — | 180 | 95 | L1-2, T2 | L2, T2 |
| V-I.3.2 | Base 3: 15.3 | 2.7 | 36 | — | 155 | 77 | L2, T2-3 | L2-3, T2-3 |
| V-I.3.3 | Base 3: 15.3 | 2.7 | — | 2.7 | 80 | 43 | L3, T3-4 | L3, T4 |
| I.3.4 | Base 3: 15.3 | 2.7 | 18 | 2.7 | 50 | 27 | L4, T4-5 | L3-4, T5 |
| I.3.5 | Base 3: 15.3 | 2.7 | 36 | 2.7 | 45 | 23 | L4, T4-5 | L4, T5 |

The invention claimed is:

1. A formulation, comprising (A) in total in a range of 1 to 50% by weight of at least one compound selected from the group consisting of methylglycinediacetic acid (MGDA), glutamic acid diacetate (GLDA) and a salt thereof, (B) in total in a range of 0.01 to 0.4% by weight of at least one zinc salt, in terms of zinc, (C) in total in a range of 0.001 to 0.045% by weight of a homo- or copolymer of ethyleneimine, and (D) optionally 0.5 to 15% by weight of bleach, based in each case on the solids content of the formulation.

2. The formulation of claim 1, wherein the formulation is phosphate- and polyphosphate-free.

3. The formulation of claim 1, wherein (C) is selected from the group consisting of a linear or branched homopolymer of ethyleneimine, and a graft copolymer of ethyleneimine.

4. The formulation of claim 1, wherein the zinc salt is selected from the group consisting of $ZnCl_2$, $ZnSO_4$, zinc acetate, zinc citrate, $Zn(NO_3)_2$, $Zn(CH_3SO_3)_2$ and zinc gallate.

5. The formulation of claim 1, wherein the formulation is solid at room temperature.

6. The formulation of claim 1, further comprising water in a range of 0.1 to 10% by weight.

7. The formulation of claim 1, comprising 0.5 to 15% by weight of bleach (D), selected from the group consisting of an oxygen bleach and a chlorine-containing bleach.

8. A process for machine cleaning crockery and/or kitchen utensils, comprising contacting the formulation of claim 1 with the crockery and/or the kitchen utensils.

9. A process for machine cleaning an item having at least one glass surface which may be decorated or undecorated, comprising contacting the formulation of claim 1 with the item.

10. The process of claim 8, wherein the machine cleaning is a washing or cleaning operation of a dishwasher.

11. The process of claim 9, wherein the item is at least one member selected from the group consisting of a drinking glass, a glass vase, and a glass cooking vessel.

12. A process for preparing the formulation of claim 1, comprising mixing (A) at least one compound selected from methylglycinediacetic acid (MGDA), glutamic acid diacetate (GLDA) and alkali metal salts thereof, (B) at least one zinc salt, (C) at least one homo- or copolymer of ethyleneimine, (D) and optionally at least one bleach selected from the group consisting of an oxygen bleach and a chlorine-containing bleach, and optionally a further ingredient with one another in one or more steps in the presence of water and subsequently removing the water.

13. The process of claim 12, wherein the water is removed by spray-drying, spray granulation or compaction.

14. The formulation of claim 1, wherein said formulation is free from heavy metal compounds which do not act as bleach catalyst.

15. The formulation of claim 1, wherein said formulation comprises 0 to 30 ppm of heavy metal compounds which do not act as bleach catalyst.

* * * * *